US007336251B2

(12) United States Patent
Osada

(10) Patent No.: US 7,336,251 B2
(45) Date of Patent: Feb. 26, 2008

(54) IMAGE DISPLAY DEVICE AND LUMINANCE CORRECTING METHOD THEREOF

(75) Inventor: Takeshi Osada, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 689 days.

(21) Appl. No.: 10/739,139

(22) Filed: Dec. 19, 2003

(65) Prior Publication Data

US 2004/0130541 A1 Jul. 8, 2004

(30) Foreign Application Priority Data

Dec. 25, 2002 (JP) ..... 2002-375674

(51) Int. Cl.

| | |
|---|---|
| ***G09G 3/30*** | (2006.01) |
| ***G09G 3/32*** | (2006.01) |
| ***G09G 3/36*** | (2006.01) |
| ***G09G 5/00*** | (2006.01) |
| ***G09G 5/10*** | (2006.01) |
| ***G09G 3/10*** | (2006.01) |

(52) U.S. Cl. ..... 345/92; 345/77; 345/82; 345/92; 345/205; 345/690; 315/169.3

(58) Field of Classification Search ..... 345/77, 345/92; 315/169.3

See application file for complete search history.

(56) References Cited

U.S. PATENT DOCUMENTS

| | | | | |
|---|---|---|---|---|
| 7,046,240 | B2 * | 5/2006 | Kimura | 345/212 |
| 7,138,967 | B2 * | 11/2006 | Kimura | 345/76 |
| 2003/0052336 | A1 * | 3/2003 | Yamazaki et al. | 257/200 |
| 2003/0103022 | A1 * | 6/2003 | Noguchi et al. | 345/77 |
| 2003/0189206 | A1 | 10/2003 | Koyama | |
| 2004/0080474 | A1 * | 4/2004 | Kimura | 345/82 |
| 2004/0095305 | A1 * | 5/2004 | Kimura et al. | 345/92 |
| 2004/0144978 | A2 * | 7/2004 | Koyama | 257/59 |
| 2004/0145547 | A1 * | 7/2004 | Oh | 345/76 |

FOREIGN PATENT DOCUMENTS

| | | |
|---|---|---|
| JP | 2002-251166 | 9/2002 |

* cited by examiner

*Primary Examiner*—Sumati Lefkowitz
*Assistant Examiner*—Alexander S. Beck
(74) *Attorney, Agent, or Firm*—Fish & Richardson P.C.

(57) ABSTRACT

The purpose of the invention is providing a current-input display device which can emit light at a constant luminance and provide a high definition display. According to the invention, a current which is almost the same as a current source can be inputted by adding a transistor in a pixel circuit, the circuit has a large output resistance enough not to be influenced by a change in I-V characteristic due to a deterioration of a light emitting element, a change in temperature and the like, and a high definition display can be obtained by conducting a correction if there are any influential changes in characteristics.

11 Claims, 9 Drawing Sheets

Prior Art

Prior Art

Prior Art

IMAGE DISPLAY DEVICE AND LUMINANCE CORRECTING METHOD THEREOF

BACKGROUND OF THE INVENTION

1. Field of the Invention

The present invention relates to an image display device having a light emitting element, and more particularly, to a remedy of reduction in luminance of the light emitting element according to a deterioration of a light emitting material.

2. Description of the Related Art

A light emitting element represented by an electro luminescence (EL) element is high in visibility, since it emits light by itself. Therefore, the light emitting element is optimum to form in a thin shape since it does not need a backlight required for a liquid crystal display device. Further, a viewing angle of the light emitting element is not restricted. Therefore, in recent years, a display device using a light emitting element attracts attention as a display device substituted for CRT (cathode-ray tube) or LCD (liquid crystal display).

On commercialization of a display device using a light emitting element, however, a problem lies in the reduction in luminance of light emitting element which accompanies the deterioration of the organic light emitting material. Reduction in luminance makes the image blurred, and in the case of colorization, luminance differs depending on colors since each color is used for different time period. Therefore, a desired color cannot be displayed on a display device.

Accordingly, a method to keep the current flowing to the light emitting element constant to emit light is suggested. By controlling the luminance of light emitting element by current, change in luminance can be prevented.

FIG. 8 is a configuration example of a pixel in which a current is kept constant for light emission (Refer to Patent Document 1, for example). Connection of the pixel is described now. The pixel includes a first transistor (hereinafter referred to as Tr1), a second transistor (hereinafter referred to as Tr2), a third transistor (hereinafter referred to as Tr3), a fourth transistor (hereinafter referred to as Tr4), a fifth transistor (hereinafter referred to as Tr5), a light emitting element 809, a power source line 810, a data signal line 801 and a scanning line 802. Gate electrodes of Tr4 and Tr5 are both connected to the scanning line 802. One of a source region and a drain region of Tr4 is connected to the data signal line 801 while the other is connected to a drain region of Tr1. One of a source region and a drain region of Tr5 is connected to the drain region of Tr1 while the other is connected to a gate electrode of Tr3. Source regions of Tr1 and Tr2 are both connected to the power source line 810. A gate electrode of Tr1 is connected to a gate electrode and a drain region of Tr2. One of a source region and a drain region of Tr3 is connected to the drain region of Tr2 while the other is connected to a pixel electrode of the light emitting element 809.

As above-mentioned pixel is configured by a current mirror circuit, when Tr4 and Tr5 are ON, a current I1 flowing through Tr1 and Tr4 and a current I2 flowing through Tr2 and Tr3 are kept at the same current value. Moreover, the current I1 is controlled by the data signal line 801, which ends in controlling the current flowing to the light emitting element 809.

FIG. 4A shows I-V characteristics of Tr2 and Tr3. A current mirror circuit configured by one pair of transistors (one stage) shows a characteristic curve A, and a current mirror circuit configured by two pairs of transistors (two stages) shows a characteristic curve B. An advantage in configuring a current mirror circuit by two pairs of transistors is that an output resistance is large, for which a current can be kept constant in a saturation region. For example, even when a voltage VEL (voltage applied to the light emitting element) in FIG. 4B fluctuates and VDS (voltage applied to a transistor) is changed (it is assumed that |VDD−VGND| is constant), the current value can be kept constant in the case of characteristic curve B.

FIGS. 5A and 5B show an I-V characteristic in the case where an EL element and a transistor are connected in series. Tr2 and Tr3 are considered to be one transistor 501 with a large output resistance. FIG. 5A is a configuration diagram and FIG. 5B shows an I-V characteristic curve in the case where a voltage applied as a whole which is VDD=VEL+VDS is constant.

A voltage applied to a driver transistor and the EL element, and a current flowing to the EL element can be obtained at the intersection point (operation point) of two I-V characteristic curves. It is confirmed in FIG. 5B that the current value at the operation point is almost the same even when a characteristic of the EL element varies, that is when the characteristic curve of the EL element changes, as long as the driver transistor operates in a saturation region and an output resistance is large enough.

By setting the current value with the data signal line 801 while Tr1, Tr2 and Tr3 operate in the saturation region, a high definition display without luminance unevenness or display unevenness can be realized. It is to be noted that an EL element is taken as a representative of a light emitting element in this invention, however, the invention is not exclusively limited to the EL element.

[Patent Document 1]

Japanese Patent Laid-Open No. 2002-251166

SUMMARY OF THE INVENTION

In the above-mentioned pixel configuration, however, when the drain region of Tr1 and the gate electrode of Tr3 are electrically connected and a threshold voltage of Tr1 is large, a drain voltage of Tr1 becomes higher than a drain voltage of Tr2 by 1V or more. Further, as each transistor has a limited output resistance, a large difference emerges between the current I1 flowing through Tr1 and Tr4, and the current I2 flowing through Tr2 and Tr3.

It is a primary object of the invention to provide an image display device wherein the current flowing to the light emitting element is controlled by controlling the current I1 with the data signal line by making no difference between the current I1 flowing through Tr1 and the current I2 flowing through Tr2. The image display device has enough output resistance not to be influenced by a variation of characteristics of light emitting elements. The image display also keeps a constant luminance even when a characteristic is remarkably changed by a deterioration of the light emitting element and a change in temperature, and is capable of high definition display.

An image display device of the invention is one which can reduce a variation in current flowing to the data signal line and the light emitting element by arranging the transistors so as to make the drain voltages equal. The image display keeps a constant luminance by a circuit with enough output resistance even when a characteristic is changed by deterioration of light emitting element and a change in temperature. And the image display device conducts a correction when the characteristic is changed so remarkably that the constant luminance cannot be kept so as to perform a high definition display.

A pixel in an image display device of the invention includes a first transistor, a second transistor, a third transistor, a fourth transistor, a fifth transistor, a sixth transistor, a light emitting element, a power source line, a data signal line, and a scanning line. Gate electrodes of the fifth and sixth transistors are both connected to the scanning line. One of a source region and a drain region of the fifth transistor is connected to the data signal line while the other is connected to a drain region of the third transistor. One of a drain region and a source region of the sixth transistor is connected to a gate electrode and a drain region of the third transistor while the other is connected to a gate electrode of the fourth transistor. Source regions of the first and second transistors are both connected to the power source line. A gate electrode of the first transistor is connected to a gate electrode and a drain region of the second transistor. A source region of the third transistor is connected to a drain region of the first transistor. One of a source region and a drain region of the fourth transistor is connected to the drain region of the second transistor while the other is connected to a pixel electrode of the light emitting element. And the first to fourth transistors operate in a saturation region.

In a pixel of the image display device of the invention, the first to fourth transistors operate in a saturation region, and a luminance of the light emitting element is controlled by controlling a drain current flowing to the first transistor.

In a pixel of the image display device of the invention, the first to fourth transistors operate in a saturation region, and a luminance of the light emitting element is controlled by controlling a drain current flowing to the first transistor with a data signal line.

A pixel of an image display device of the invention including a first transistor, a second transistor, a third transistor, a fourth transistor, a fifth transistor, a sixth transistor, an erasing transistor, a light emitting element, a power source line, a data signal line, a scanning line, and an erasing signal line, wherein gate electrodes of the fifth and sixth transistors are both connected to the scanning line, one of a source region and a drain region of the fifth transistor is connected to the data signal line while the other is connected to a drain region of the third transistor, one of a drain region and a source region of the sixth transistor is connected to a gate electrode and the drain region of the third transistor while the other is connected to a gate electrode of the fourth transistor, a gate electrode of the erasing transistor is connected to the erasing signal line, one of a source region and a drain region of the erasing transistor is connected to the power source line while the other is connected to the gate electrode of the fourth transistor, source regions of the first and second transistors are both connected to the power source line, a gate electrode of the first transistor is connected to a gate electrode and a drain region of the second transistor, a source region of the third transistor is connected to a drain region of the first transistor, one of a source region and a drain region of the fourth transistor is connected to the drain region of the second transistor while the other is connected to a pixel electrode of the light emitting element, and the first to fourth transistors operate in a saturation region.

In a pixel of the image display device of the invention, the first to fourth transistors operate in a saturation region, and a luminance of the light emitting element is controlled by controlling a drain current flowing to the first transistor.

In a pixel of the image display device of the invention, the first to fourth transistors operate in a saturation region, and a luminance of the light emitting element is controlled by controlling a drain current flowing to the first transistor with a data signal line.

In a pixel of the image display device of the invention, a luminance of the light emitting element is controlled by controlling the fourth transistor with the erasing signal line.

In a luminance correction method of the image display device of the invention, a luminance of the light emitting element is controlled by adjusting a cathode potential of the light emitting element to an appropriate value according to a voltage between the fourth transistor and the light emitting element.

An image display device of the invention is one which can reduce a variation in current flowing to the data signal line and the light emitting element by arranging the transistors so as to make the drain voltages thereof equal. The image display device keeps a constant luminance by a circuit with enough output resistance even when a characteristic of the light emitting element is changed by deterioration thereof and a change in temperature. And the image display device conducts a correction when the characteristic is changed so remarkably that the constant luminance cannot be kept so as to perform a high definition display.

DETAILED DESCRIPTION OF THE PREFERRED EMBODIMENTS

The invention is described in detail in the following embodiment modes.

[Embodiment Mode 1]

Figure 1:
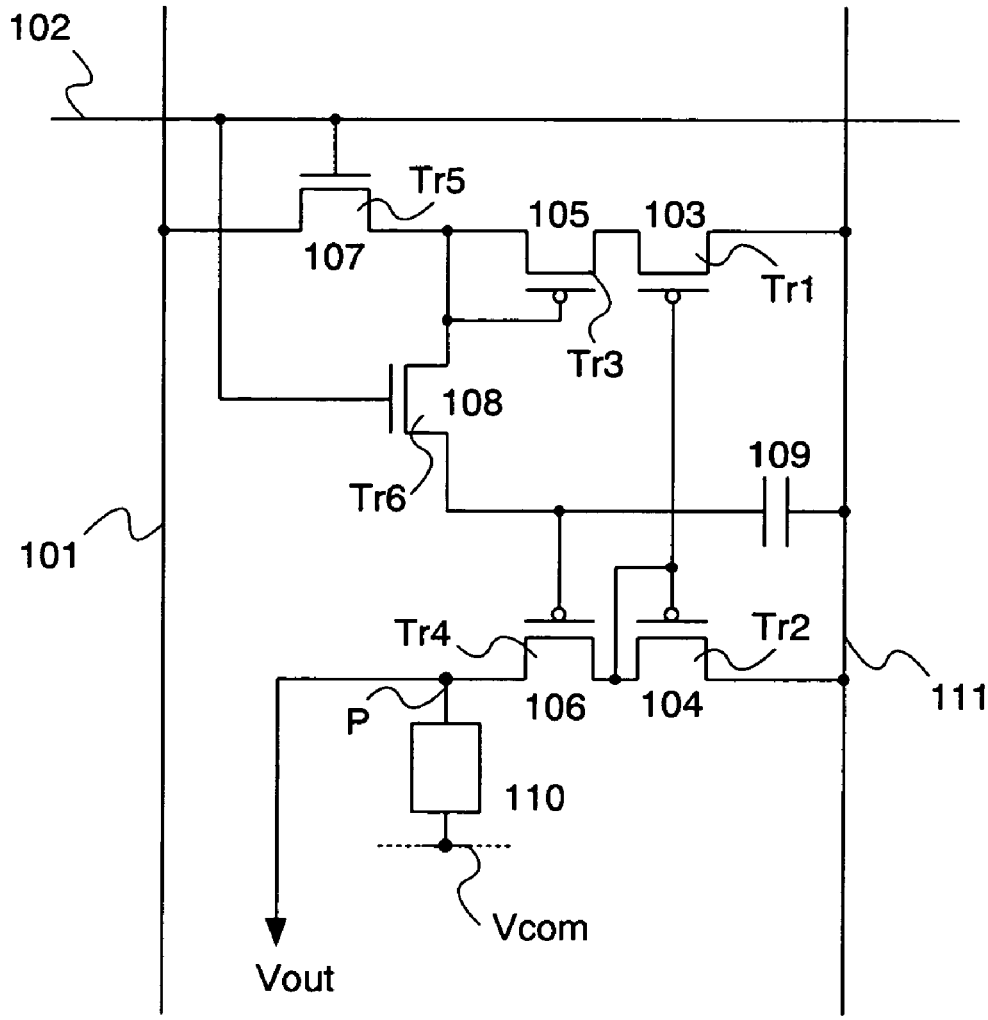
FIG. 1 is a diagram showing an embodiment mode of the invention.

FIG. 1 shows a pixel circuit according to Embodiment Mode 1 of the invention. The pixel circuit includes a first transistor Tr1, a second transistor Tr2, a third transistor Tr3, a fourth transistor Tr4, a fifth transistor Tr5, a sixth transistor Tr6, a light emitting element 110, a power source line 111, a data signal line 101, a scanning line 102, and a capacitor 109.

Gate electrodes of the transistor Tr5 and Tr6 are both connected to the scanning line. One of a source region and a drain region of the transistor Tr5 is connected to the data signal line 101 while the other is connected to a drain region of the transistor Tr3. Further, one of a drain region and a source region of the transistor Tr6 is connected to a gate electrode and the drain region of the transistor Tr3 while the other is connected to a gate electrode of the transistor Tr4.

Source regions of the transistors Tr1 and Tr2 are both connected to the power source line. A gate electrode of the transistor Tr1 is connected to a gate electrode and a drain region of the transistor Tr2. A source region of the transistor Tr3 is connected to a drain region of the transistor Tr1.

One of a source region and a drain region of the transistor Tr4 is connected to the drain region of the transistor Tr2 while the other is connected to a pixel electrode of the light emitting element 110. The light emitting element has an anode and a cathode, and in the case where the anode is used as a pixel electrode (first electrode), the cathode is used as a counter electrode (second electrode) in this specification.

A potential of the power source line 111 is kept at a constant value. Also a potential of the counter electrode is kept at a constant value during the pixel operation.

The capacitor 109 is formed between a gate electrode of the transistor Tr4 and the power source line 111. The capacitor 109 is provided for the purpose of keeping the voltage between the gate electrode and the source region of the transistor Tr4 (gate voltage) more accurately, however, it is not necessarily needed.

Moreover, a storage capacitor may be formed between the gate electrodes of the transistors Tr1 and Tr2 and the power source line to keep the gate voltage of the transistors Tr1 and Tr2 more accurately.

Figure 6A:
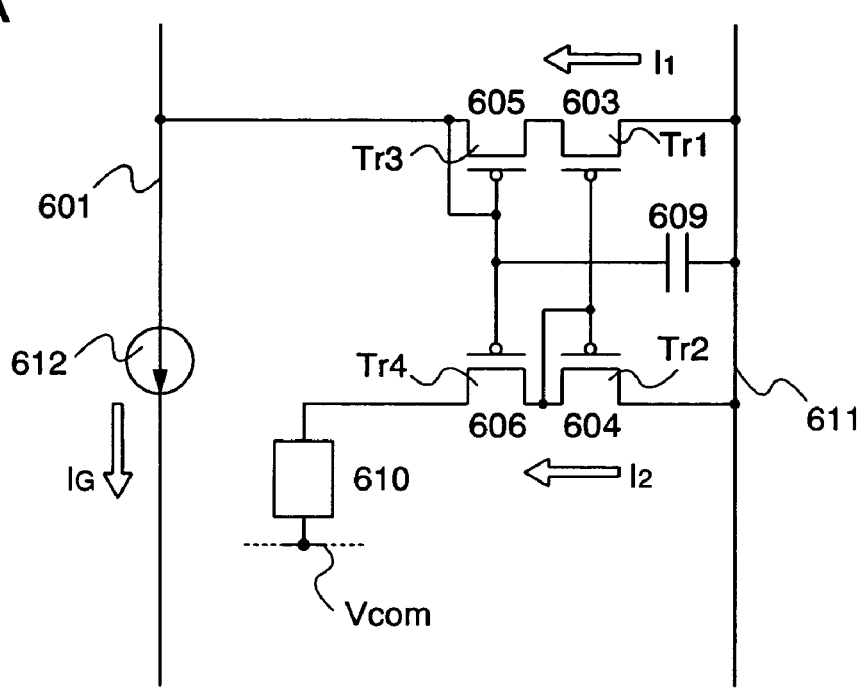
FIGS. 6A and 6B are diagrams showing electrical connections during operation of an embodiment mode of the invention.

Subsequently, a drive of an image display device of the invention is explained with reference to FIGS. 6A and 6B. FIG. 6A shows a schematic diagram of a pixel in the case where a scanning line is selected, that is the case where all the transistors whose gate electrodes are connected to the scanning line are in the states of ON. It is assumed that at this time a constant current IG flows through a data signal line 601 from a current source 612. The transistors Tr5 and Tr6 are in the states of ON, therefore, when a constant current IG flows through the data signal line 601, I1=IG flows between the drain regions and source regions of the transistors Tr1 and Tr3. The current IG at this time is controlled with the current source 612 so that the transistors Tr1 and Tr3 operate in the saturation region.

In the saturation region, it is assumed that Vgs is a potential difference between a gate electrode and a source region (gate voltage), μ is a mobility of a transistor, C is a gate capacitance per unit area, W/L is the ratio of the channel width W and the channel length L in a channel forming region, Vth is a threshold voltage, the drain current of the first transistor Tr1 is I1, then the following formula is satisfied.

$$I_1 = \frac{\mu C}{2} \cdot \frac{W}{L} \cdot (V_{gs} - V_{th})^2 \qquad \text{[Formula 1]}$$

In formula 1, all of μ, C, W/L, and Vth are a fixed value dependent on each transistor. Moreover, the drain current I1 of the transistor Tr1 is kept at constant current IG by the current source 612. Therefore, as is apparent from formula 1, a gate voltage of the transistor Tr1 is determined by the current value.

The gate electrode of the transistor Tr2 is connected to the gate electrode of the transistor Tr1. Also, the source region of the transistor Tr2 is electrically connected to the source region of the transistor Tr1. Therefore, the gate voltage of the transistor Tr1 equals the gate voltage of the transistor Tr2. Therefore, a drain current I2 of the transistor Tr2 is kept the same as the drain current I1 of the transistor Tr1. That is, I2=I1=IG is satisfied.

Further, the drain current of the transistor Tr2 is equal to the drain current of the transistor Tr4. According to formula 1, the transistor Tr4 generates a gate voltage according to the drain current.

The drain current of the transistor Tr2 thus flows into a light emitting element 610 through a channel formation region of the transistor Tr4. Accordingly, a driving current of the light emitting element 610 is equal to the constant current IG set by the current source 612.

The light emitting element 610 emits light at a luminance according to the driving current of the light emitting element 610. When the driving current thereof is extremely close to 0 or when the driving current flows in the reverse bias direction, the light emitting element 610 does not emit light.

Figure 6B:
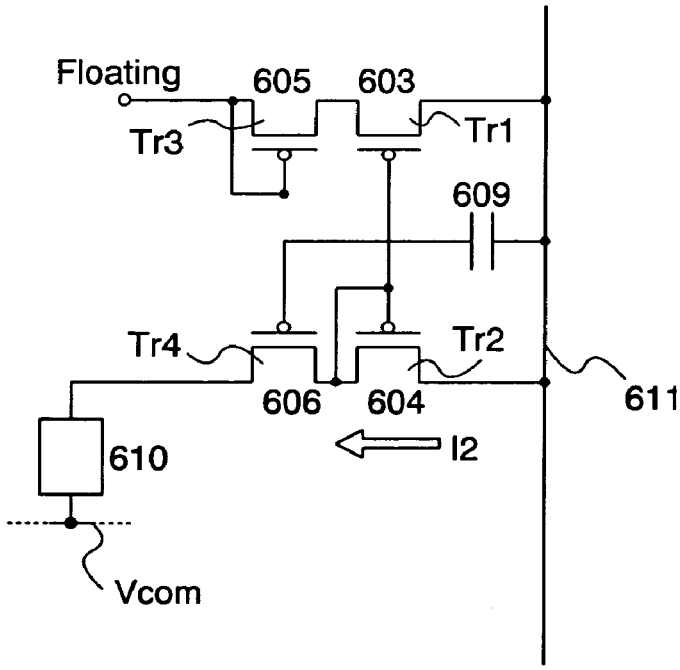

FIG. 6B shows a schematic diagram showing a pixel in the case where all the transistors whose gate electrodes are connected to the scanning line are in the states of OFF. The transistors Tr5 and Tr6 are in the states of OFF and the source regions of the transistors Tr1 and Tr2 are connected to the power source line 611 and kept at constant potentials (power source potential).

A drain region of the transistor Tr3 is in so-called a floating state, in which a potential is not given from other wirings, a power source and the like. On the other hand, a voltage between the gate and source determined while the scanning line is selected is kept as it is at the transistors Tr2 and Tr4. Therefore, a value of the drain current I2 of the transistor Tr2 is kept at IG and moreover, the transistor Tr4 also keeps the voltage between the gate and source which flows the current I2. That is, the light emitting element emits light at a luminance according to the driving current as a driving current IG to the light emitting element 610 which is determined while the scanning line is selected is kept as it is even after the selection of the scanning line is terminated.

[Embodiment Mode 2]

Figure 2:
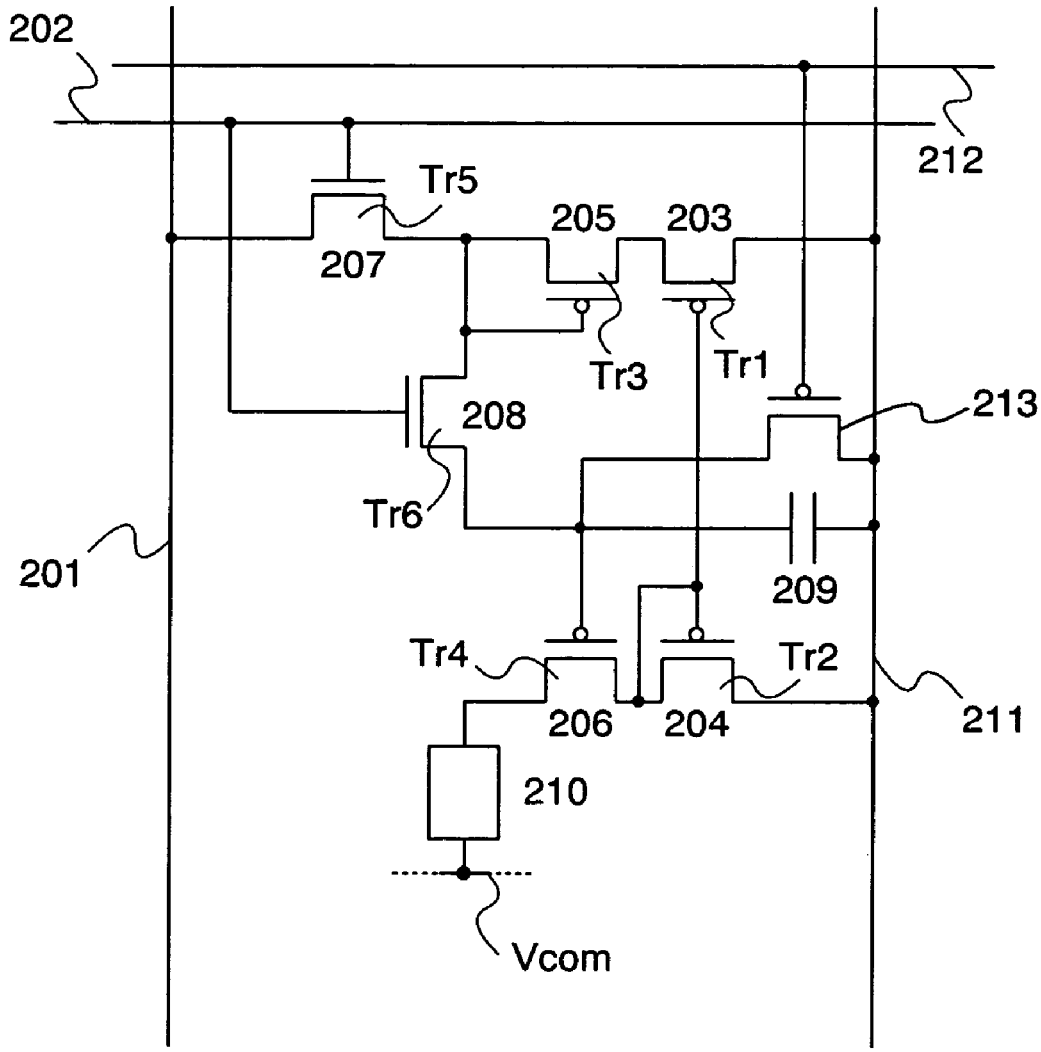
FIG. 2 is a diagram showing an embodiment mode of the invention.

FIG. 2 shows a pixel circuit according to Embodiment Mode 2 of the invention. The pixel circuit includes a first transistor Tr1, a second transistor Tr2, a third transistor Tr3, a fourth transistor Tr4, a fifth transistor Tr5, a sixth transistor Tr6, a light emitting element 210, a power source line 211, a data signal line 201, a scanning line 202, a capacitor 209, an erasing signal line 212, and an erasing transistor 213.

The above-mentioned circuit is one in which an erasing circuit is added to the circuit of Embodiment Mode 1, and the description of the connection is made on the added circuit only. A gate electrode of the erasing transistor 213 is connected to the erasing signal line 212 and the erasing transistor 213 is provided between the power source line 211 and a gate electrode of the transistor Tr4.

A potential of the power source line 211 is kept at a constant value. Also a potential of a counter electrode is kept at a constant value during the pixel operation.

The capacitor 209 is formed between the gate electrode of the transistor Tr4 and the power source line 211. The capacitor 209 is provided for the purpose of keeping the voltage between the gate electrode and the source region of the transistor Tr4 (gate voltage) more accurately, however, it is not necessarily needed.

Moreover, a storage capacitor may be formed between gate electrodes of the transistors Tr1 and Tr2 and the power source line to keep the gate voltage of the transistors Tr1 and Tr2 more accurately.

Subsequently, a drive of an image display device of the invention is explained. The difference from Embodiment 1 is that an erasing period is added. As is in Embodiment 1, a light emitting element emits light at a luminance according to the driving current as the driving current IG to the light emitting element 210 which is determined while the scanning line is selected is kept as it is even after the selection of the scanning line is terminated. At this time, the erasing signal line 212 is selected and the erasing transistor is turned ON, then the transistor Tr4 is turned OFF and a current does not flow to the light emitting element 210, which terminates the light emission. In order to start light emission again, a constant current IG has to flow while the scanning line is selected.

[Embodiment Mode 3]

Figure 5A:
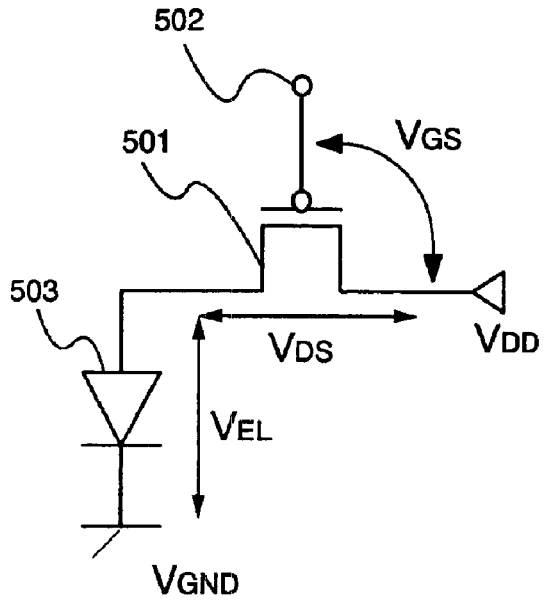
FIGS. 5A and 5B are diagrams showing an I-V characteristic of a series circuit of a TFT and an EL element.
Figure 5B:
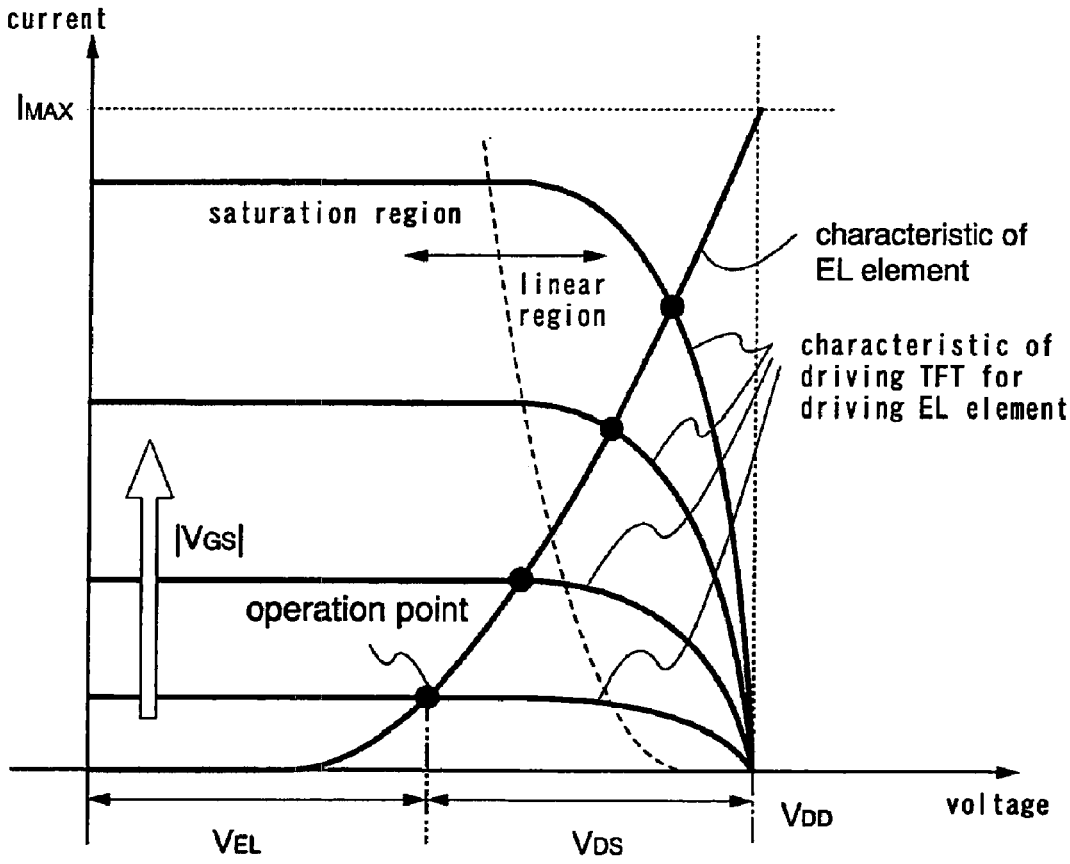
Prior Art Fig. 5B
Figure 7:
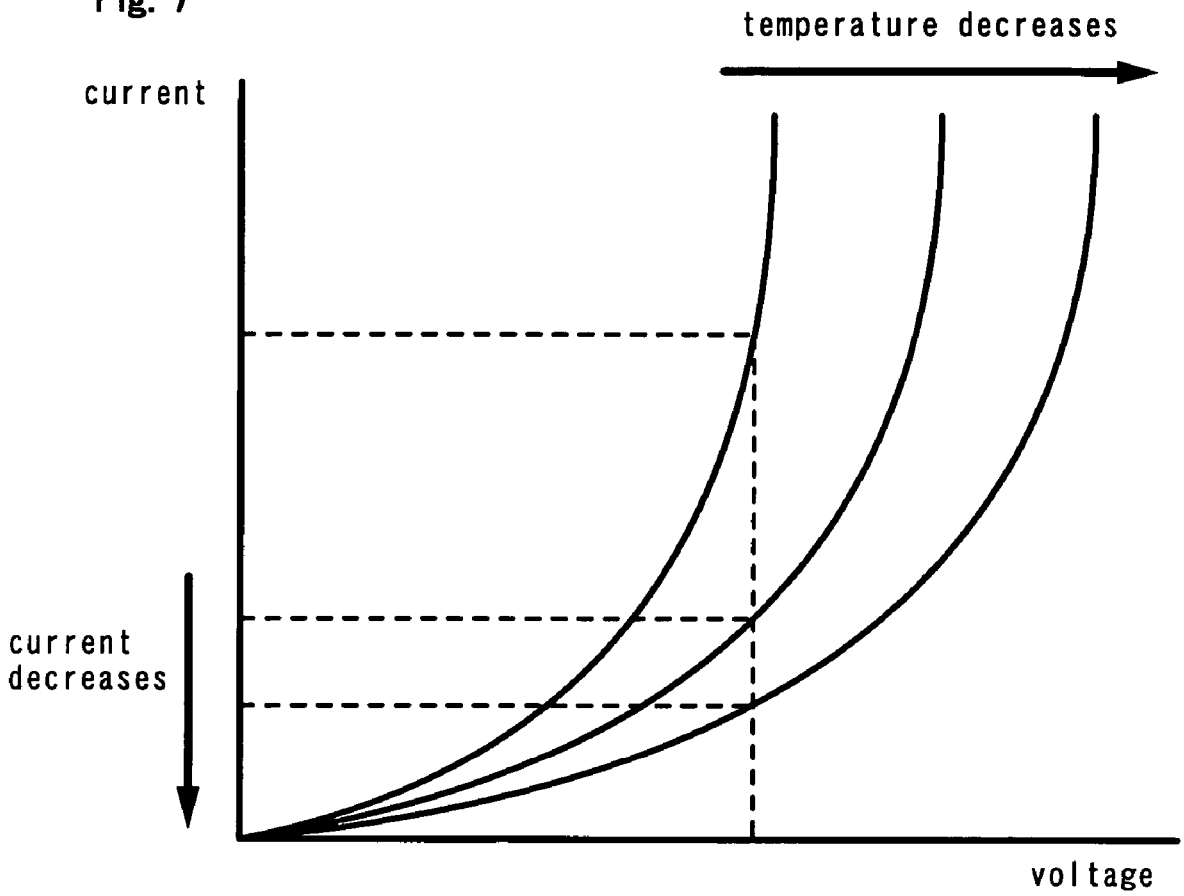
FIG. 7 is a diagram showing an I-V characteristic of a light emitting element.
Figure 8:
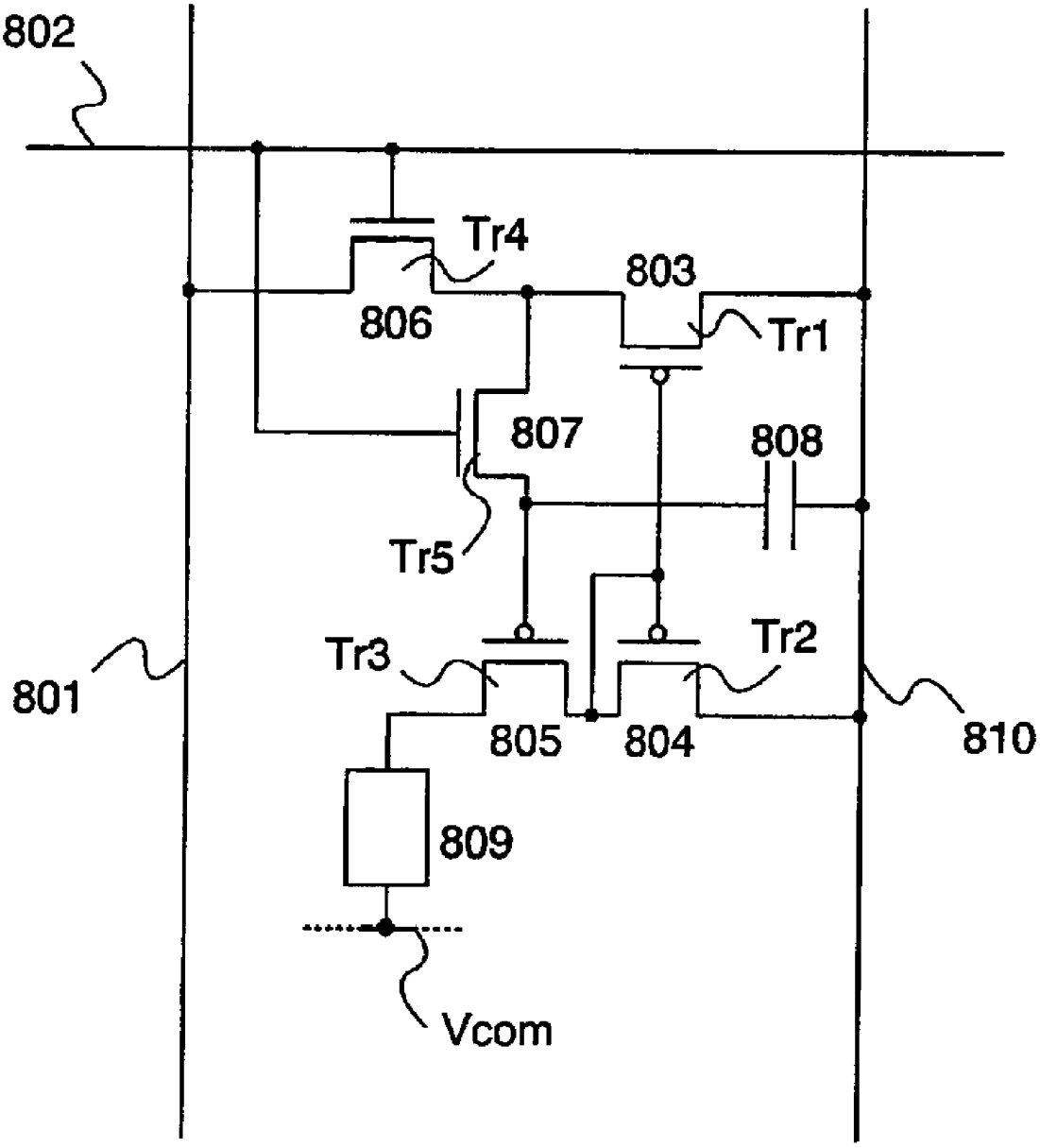
FIG. 8 is a diagram showing a conventional pixel circuit.

The third Embodiment mode of the invention is explained now. FIG. 5B shows a characteristic curve of an EL element and a driving TFT. It is confirmed in FIG. 5B that an intersection point (operation point) is required to be within the saturation region of the driving TFT so as not to be influenced by the variation of the EL element. Also, in a pixel circuit of the invention, a current source is required to be set so that the transistors Tr1 to Tr4 operate in the saturation region in order to make the current value stable. However, as shown in FIG. 7, the light emitting element changes its IV characteristic according to temperature. Provided that a constant voltage is supplied, the more the temperature of the light emitting element rises, the more the driving current increases. The temperature of the light emitting element is dependent not only on the outside temperature but also on a heat generated from the panel itself, therefore a considerable care is required.

Figure 9:
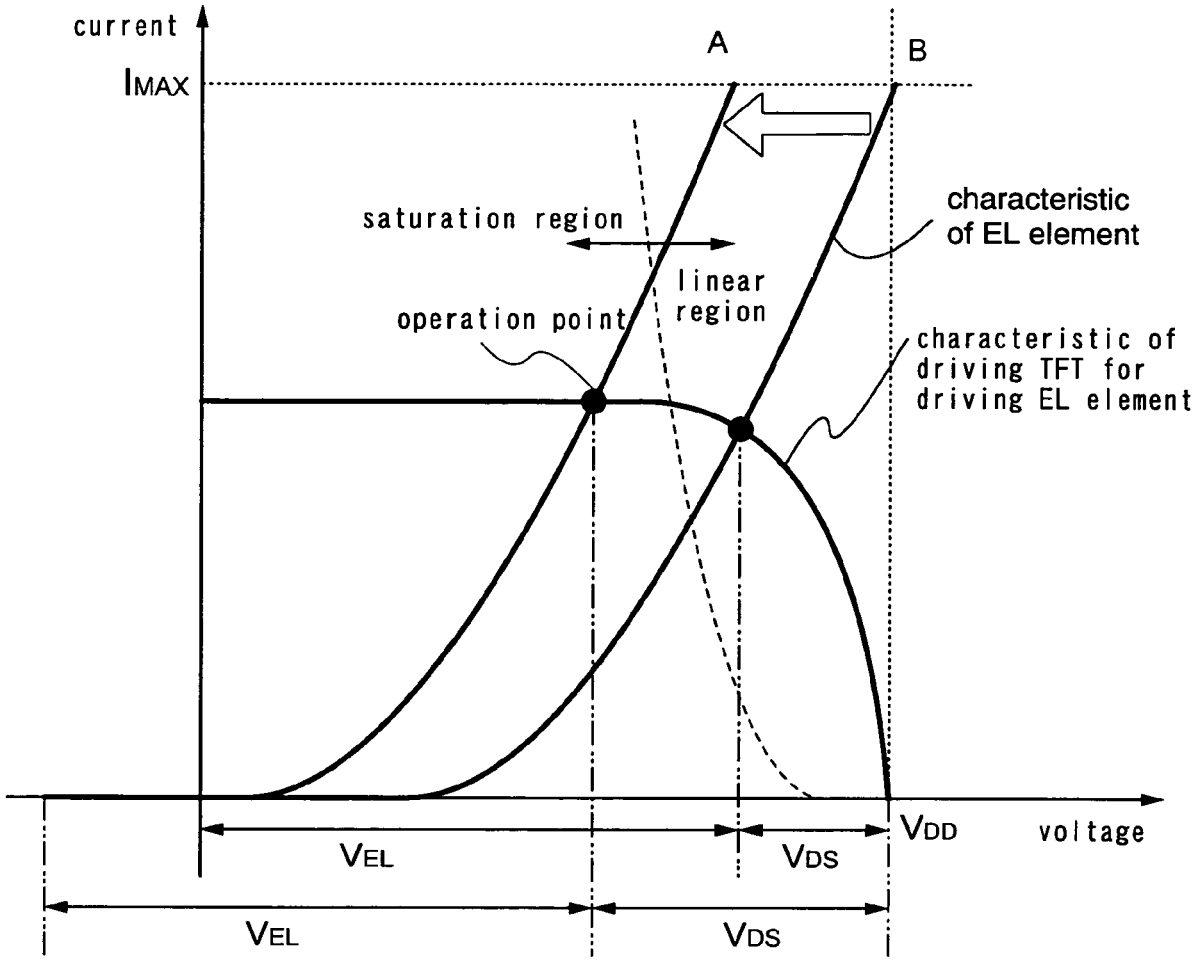
FIG. 9 is a diagram showing a luminance correcting method.

Then, a potential at a point P in FIG. 1 is monitored. This potential corresponds to an operation point in FIG. 9. In the case where the operation point under the current value IG of the current source was adequately in the saturation region in the initial setting but became like a characteristic curve B in FIG. 9 due to the deterioration or the change in temperature of the light emitting element, it can be detected by monitoring that the operation point is in the linear region, with a knowledge of the characteristic curve of a driving TFT. In the case where the operation point is in the linear region, a potential of a cathode (counter electrode) is lowered so as to return to the characteristic curve A.

The above-mentioned correction method does not have to be an analogue correction as long as an output resistance of the driving TFT (current mirror circuit) is large enough. The potential may be lowered at even intervals as well. Furthermore, the correction method is not exclusively limited to the circuit of the invention, but any driving method in which a constant current flows to the light emitting element is efficient.

Hereinafter explained is an embodiment of the invention.

[Embodiment]

Figure 3:
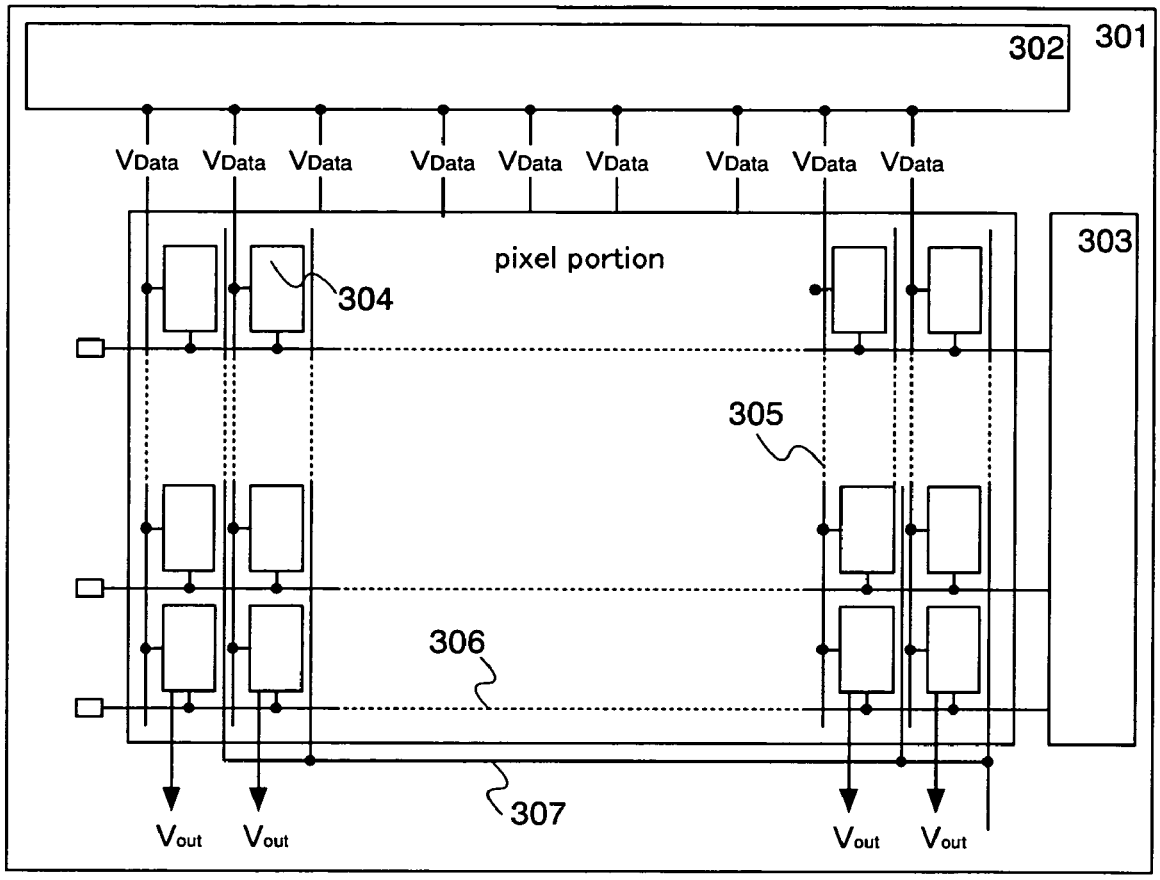
FIG. 3 is a diagram showing one embodiment of the invention.
Figure 4A:
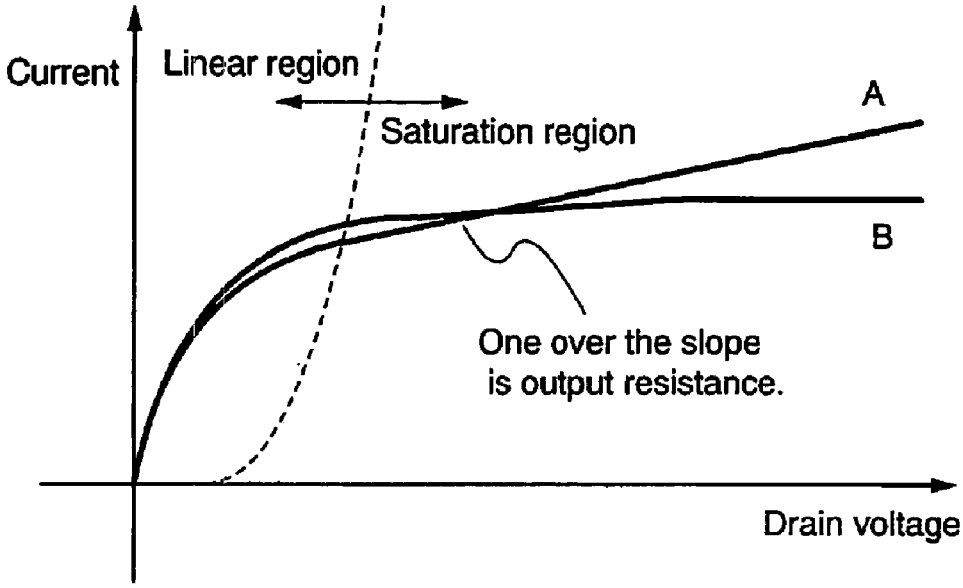
FIGS. 4A and 4B are diagrams showing an I-V characteristic of a transistor.
Figure 4B:
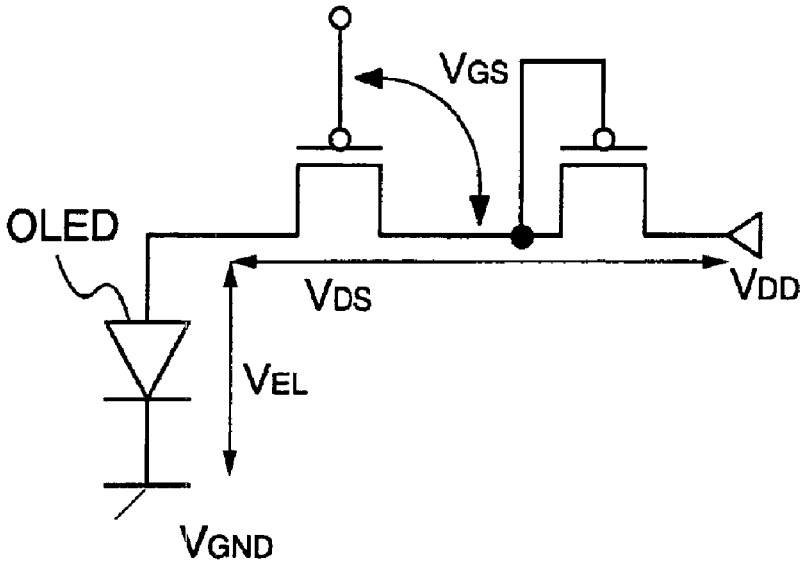
Prior Art Fig. 4B

FIG. 3 shows the first embodiment of the invention. A substrate 301 of the invention is configured by a plurality of pixels 304 arranged in matrix in a pixel portion, and a data signal line 305, a scanning line 306, and a power source line 307 are arranged so as to be crossed with each other corresponding to the location of the pixels. The data signal line 305 is controlled by a source driver circuit 302 and the scanning line 306 is controlled by a gate driver circuit 303.

One source driver circuit 302 and one gate driver circuit 303 are provided in each in FIG. 3, however, the invention is not exclusively limited to this configuration. The numbers of the source driver circuit 302 and the gate driver circuit 303 can be set arbitrarily by a designer.

Moreover, the data signal line 305, the scanning line 306, and the power source line 307 are provided in the pixel portion in FIG. 3, however, the numbers of them are not necessarily the same. Moreover, other wirings may be provided besides these wirings.

The power source line 307 is kept at a predetermined potential. It is to be noted that FIG. 3 shows a configuration of a light emitting device which displays a monochrome image, however, the invention may be a light emitting device which displays an image in color. In that case, the potential of the power source line 307 does not have to be all the same, but may vary according to the corresponding colors.

A display of an image is performed by repeating firstly a write period, then a display period. First of all, a scanning line which is perpendicular to the gate driver circuit is selected. Secondly, each constant current corresponding to a video signal flows from each data signal line 305. Note that, the source driver circuit 302 has a current source. Thus, a luminance for each light emitting element is set.

Subsequently, selection of the scanning line is terminated and the display period starts. Display is performed at a luminance which is set during the write period.

In the case where the substrate includes an erasing signal and an erasing signal line driver circuit, the erasing signal may be selected when needed after the display period.

Moreover, in the case where a driver potential of the light emitting element is monitored to correct the luminance, a potential of a cathode (counter electrode) is set to an appropriate value according to a potential output Vout. The potential is set by making a pixel with an output for monitoring display in the write period and the display period in this order, reading the potential output Vout, and judging if the operation point is in the saturation region, accordingly, the potential of the cathode (counter electrode) is set. An arrangement for the pixel with an output for monitoring is not exclusively limited in the periphery of the pixel portion as in FIG. 3. Further, the number of pixels does not have to be a whole row of pixels.

What is claimed is:

1. An image display device comprising:

a first transistor;

a second transistor;

a third transistor;

a fourth transistor;

a fifth transistor;

a sixth transistor;

a light emitting element;

a power source line;

a data signal line; and a scanning line, wherein:

gate electrodes of the fifth and sixth transistors are both connected to the scanning line, one of a source region and a drain region of the fifth transistor is connected to the data signal line while the other is connected to a drain region of the third transistor, one of a drain region and a source region of the sixth transistor is connected to a gate electrode and the drain region of the third transistor while the other is connected to a gate electrode of the fourth transistor, source regions of the first and second transistors are both connected to the power source line, a gate electrode of the first transistor is connected to a gate electrode and a drain region of the second transistor, and a source region of the third transistor is connected to a drain region of the first transistor, one of a source region and a drain region of the fourth transistor is connected to the drain region of the second transistor while the other is connected to a pixel electrode of the light emitting element.

2. An image display device according to claim 1, wherein the first to fourth transistors operate in a saturation region; and a luminance of the light emitting element is controlled by controlling a drain current flowing to the first transistor.

3. An image display device according to claim 1, wherein the first to fourth transistors operate in a saturation region;

a luminance of the light emitting element is controlled by controlling a drain current flowing to the first transistor with the data signal line.

4. An image display device according to claim 1, wherein the first to fourth transistors operate in a saturation region.

5. An image display device comprising:

a first transistor;

a second transistor;

a third transistor;

a fourth transistor;

a fifth transistor;

a sixth transistor;

an erasing transistor;

a light emitting element;

a power source line;

a data signal line;

a scanning line;

and an erasing signal line, wherein: gate electrodes of the fifth and sixth transistors are both connected to the scanning line, one of a source region and a drain region of the fifth transistor is connected to the data signal line while the other is connected to a drain region of the third transistor, one of a drain region and a source region of the sixth transistor is connected to a gate electrode and the drain region of the third transistor while the other is connected to a gate electrode of the fourth transistor, a gate electrode of the erasing transistor is connected to the erasing signal line, one of a source region and drain region of the erasing transistor is connected to the power source line while the other is connected to the gate electrode of the fourth transistor, source regions of the first and second transistors are both connected to the power source line, a gate electrode of the first transistor is connected to a gate electrode and a drain region of the second transistor, and a source region of the third transistor is connected to a drain region of the first transistor, one of a source region and a drain region of the fourth transistor is connected to a drain region of the second transistor while the other is connected to a pixel electrode of the light emitting element.

6. An image display device according to claim 5, wherein the first to fourth transistors operate in a saturation region, a luminance of the light emitting element is controlled by controlling a drain current flowing to the first transistor.

7. An image display device according to claim 5, wherein the first to fourth transistors operate in a saturation region, and a luminance of the light emitting element is controlled by controlling a drain current flowing to the first transistor with the data signal line.

8. An image display device according to claim 5, a luminance of the light emitting element is controlled by controlling the fourth transistor with the erasing signal line.

9. An image display device according to claim 5, wherein the first to fourth transistors operate in a saturation region.

10. An image display device comprising:

a first transistor;

a second transistor;

a third transistor;

a fourth transistor;

a fifth transistor;

a sixth transistor;

a light emitting element;

a power source line;

a data signal line; and a scanning line, wherein:

gate electrodes of the fifth and sixth transistors are both electrically connected to the scanning line, one of a source region and a drain region of the fifth transistor is electrically connected to the data signal line while the other is electrically connected to a drain region of the third transistor, one of a drain region and a source region of the sixth transistor is electrically connected to a gate electrode and the drain region of the third transistor while the other is electrically connected to a gate electrode of the fourth transistor, source regions of the first and second transistors are both electrically connected to the power source line, a gate electrode of the first transistor is electrically connected to a gate electrode and a drain region of the second transistor, and p1 a source region of the third transistor is electrically connected to a drain region of the first transistor, and one of a source region and a drain region of the fourth transistor is electrically connected to the drain region of the second transistor while the other is electrically connected to a pixel electrode of the light emitting element.

11. An image display device according to claim 10, further comprising:

an erasing transistor; and an erasing signal line, wherein:

a gate electrode of the erasing transistor is electrically connected to the erasing signal line, and one of a source region and drain region of the erasing transistor is electrically connected to the power source line while the other is electrically connected to the gate electrode of the fourth transistor.

* * * * *